United States Patent [19]

Howard

[11] 4,113,098

[45] Sep. 12, 1978

[54] PILL-DISPENSING AND STORAGE CONTAINER

[76] Inventor: Charles S. Howard, 1500 W. 13th St., Upland, Calif. 91786

[21] Appl. No.: 800,351

[22] Filed: May 25, 1977

[51] Int. Cl.[2] ..... B65D 43/20; B65D 85/56

[52] U.S. Cl. ..... 206/540; 206/1.5; 220/345; 220/351; 229/9

[58] Field of Search ..... 206/540, 1.5, 361, 266; 220/345, 351; 229/9, 19

[56] References Cited

U.S. PATENT DOCUMENTS

| | | | |
|---|---|---|---|
| 2,434,706 | 1/1948 | Malyszko | 220/345 |
| 2,777,570 | 1/1957 | Mytinger | 220/345 |
| 2,984,401 | 5/1961 | Herkender | 206/361 |
| 3,262,747 | 7/1966 | Kotzek et al. | 220/345 |
| 3,888,350 | 6/1975 | Horvath | 206/540 |
| 3,907,103 | 9/1975 | Shaw | 206/1.5 |

*Primary Examiner*—William T. Dixson, Jr.
*Attorney, Agent, or Firm*—Boniard I. Brown

[57] ABSTRACT

A dispensing and storage container for various articles, particularly pills, wherein the stored articles are readily available when needed, without risking the chance of the container being opened accidentally, the container comprising a cover adapted to slidably received a rectangular receptacle formed to define a compartment. The cover includes longitudinal side walls having channels disposed therein to slidably receive rail members integrally formed along the side walls of the receptacle. To prevent accidental opening of the container the forward wall of the receptacle is provided with a lock recess in which a locking lug is removable received, the locking lug being integrally formed along the forward edge of the cover. In order to unlock the cover from the receptacle, the cover is provided with a pair of oppositely arranged, flexible tab members which, when pressed inwardly, cause the cover to bow and thus disengage the locking lug from the locking recess, whereby the cover can be moved rearwardly of the receptacle and thus expose the storage compartment.

5 Claims, 7 Drawing Figures

PILL-DISPENSING AND STORAGE CONTAINER

BACKGROUND OF THE INVENTION

1. Field of the Invention

This invention relates generally to a dispensing and storage container and, more particularly, to a dispensing container for pills having a lockable cover to prevent accidental opening or easy access to children, for example.

2. Description of the Prior Art

As is well known in the art, various problems and difficulties are encountered in providing suitable means for controlling the dispensing of pills and related medication. That is, medication of all types should be accessible to some and inaccessible to others, particularly small children. Thus, many ways are being devised to prevent containers, such as boxes or bottles from being easily opened by children and other individuals under various conditons.

It is also necessary to provide a container that must be actuated in a particular manner before a lid or cover can be opened or removed. Many people carry various pill boxes along with them and find that they have accidentally opened, allowing the articles contained therein to be spilled out and generally contaminated so that the medication is rendered undesirable or even unuseable.

Several types of dispensing containers are known as exemplified in U.S. Pat. No. 3,397,770, also issued to the present inventor. This patent discloses a plurality of cavities to keep the articles in place; however, this particular container does not include a locking device as will hereinafter be disclosed.

Other devices, however, are disclosed in U.S. Pat. Nos. 3,820,655 and 3,870,192.

To the applicant's knowledge the features are presented herein are not known in the art, including the above-mentioned patents.

SUMMARY OF THE INVENTION

The dispensing-and-storage container disclosed herein has a generally rectangular configuration, wherein the container includes a substantially flat, box-like receptacle that is provided with side walls having side rails, and a forward wall having a lock recess. The rails are arranged to be slidably received in elongated channels formed in the side walls of a cover, the cover being lockable in a closed position. That is, the leading forward edge of the cover is provided with a depending locking lug that is adapted to be received in the receptacle locking recess each time the cover is fully closed thereon.

In order to open the container and expose the pills or other articles stored in the compartment defined by the receptacle, there is provided a pair of oppositely disposed, flexible tab members formed in the forward side walls of the cover. When the tabs are forced inwardly, the cover bows upwardly, thus disengaging the locking lug from the lock recess and allowing the receptacle and the cover to slide in open relationship to each other.

Thus, direct force must be applied at the right point before access to the pills or medication can be had.

OBJECT AND ADVANTAGES OF THE INVENTION

The present invention has for an important object a provision wherein the cover must have pressure applied at a particular point, so as to release the locking arrangement between the cover and receptacle thereof.

It is another object of the invention to provide a dispensing-and-storage container that is adapted with a locking means wherein children can not be easily provided with access thereto, or wherein the cover can not be inadvertently removed therefrom.

It is a further object of the invention to provide a controlled dispensing container for pills and like medication, wherein the parts are made of plastic materials and wherein the thin plastic cover is pliable so as to be flexible enough to allow disengagement of the locking elements.

It is still further object to provide a dispensing container of this type that is simple and rugged in construction.

And still another object of the invention is to provide a device of this character that is relatively inexpensive to manufacture.

The characteristics and advantages of the invention are further sufficiently referred to in connection with the accompanying drawings, which represent one embodiment. After considering this example, skilled persons will understand that variations may be made without departing from the principals disclosed; and I contemplate the employment of any structures, arrangements or modes of operations that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figure 1:
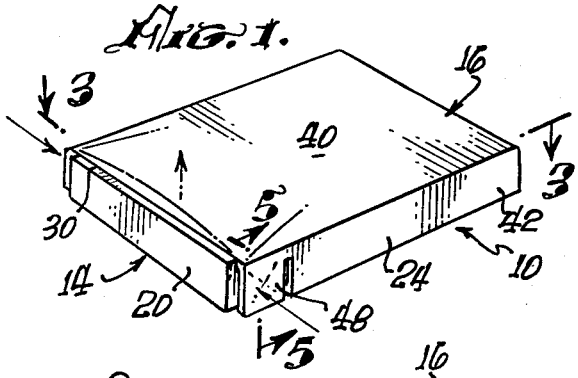
FIG. 1 is a perspective view of the dispensing-and-storage container shown in a closed, locked arrangement.

Referring more particularly to the drawings, there is shown a container, generally indicated at 10, for storing and dispensing pills and like medication 12, wherein the pills and/or related articles are allowed to be dispensed under controlled conditions. That is, said container 10 comprises a receptacle 14 having a generally rectangular, flat configuration which includes a slidable cover 16.

Arranged between cover 16 and receptacle 14 is a releasable locking means, which will hereinafter be described in detail. First, however, it should be noted that receptacle 14 comprises a rectangular bottom member 18 having a front wall 20, a rear wall 22, and oppositely disposed side walls 24, whereby there is defined a storage compartment 25. The forward or front wall 20 is formed having an enlarged thickness thereto, as seen in the cross-sectional view of FIG. 4. Thus, centrally positioned within the upper edge 26 of front wall 20 is a lock recess 28. Said front wall 20 also includes an upstanding lip member 30, formed along the full length thereof and projects upwardly so as to allow engagement therewith by cover 16, as seen in FIG. 1.

Accordingly, when cover 16 is locked in a closed mode, the leading or forward edge 32 of said cover 16 abuts against said wall lip 30, thereby preventing forward movement thereof over receptacle 14. In this locked or closed position, a depending locking lug 34, which is integrally formed as part of said cover 16, is lockably received in said recess 28, and, thus, receptacle 14 and cover 16 can not move relative to each other.

Figure 6:
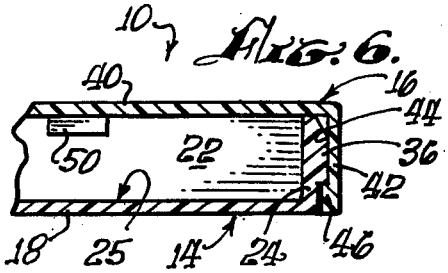
FIG. 6 is another cross-sectional view taken along line 6—6 of FIG. 2, illustrating the rail and channel elements therein.
Figure 3:
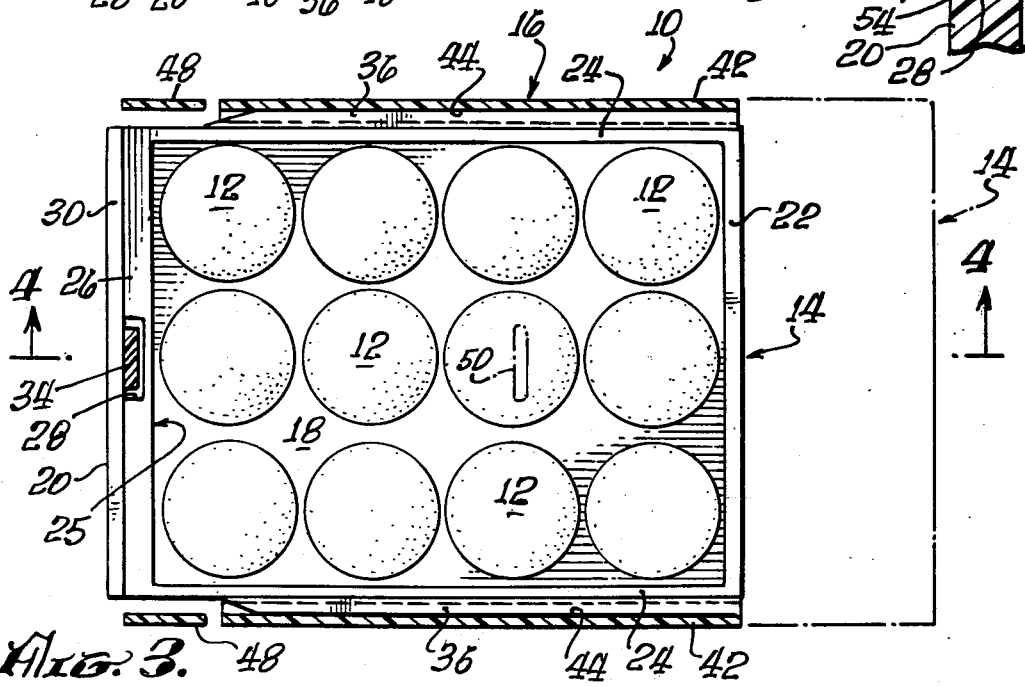
FIG. 3 is an enlarged, cross-sectional view thereof taken substantially along line 3—3 of FIG. 1.

A sliding means is provided between the cover 16 and receptacle 14; and this means comprises a pair of rails 36 which are integral parts of each side wall 24, as seen in FIGS. 3 and 6. Each rail 36 extends longitudinally and forward from the rear wall 22, and terminates just prior to and adjacent the forward wall 20, wherein the forward end of each rail has a beveled terminating end.

Figure 4:
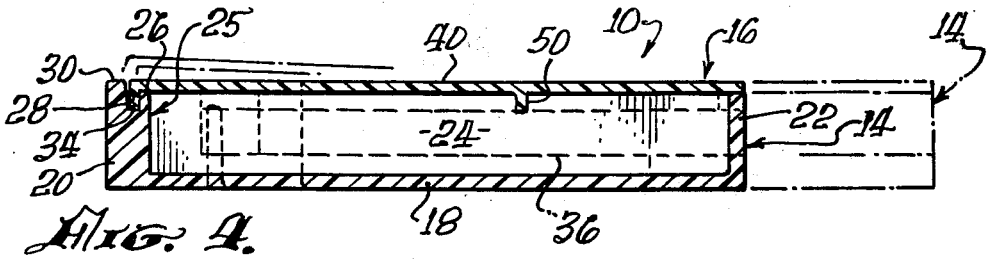
FIG. 4 is a cross-sectional view taken along line 4—4 of FIG. 3.

Cover 16 comprises a top member 40 having a configuration to completely enclose compartment 25, as seen in FIG. 1 and 4. Depending and oppositely arranged side members 42 are integrally formed to said top member, whereby said cover is made from any suitable pliable plastic material. The side members 42 include longitudinally disposed channel members 44 which are formed by flange 46, said flange being projected inwardly thereof to engage wall 24 just below rail 36. Thus, when the cover is not locked or is released from a locked position from receptacale 14, said cover and said receptacle are allowed to slide longitudinally relative to each other.

However, there is provided a means for releasably disengaging said lug 34 from said recess 28. This means comprises a pair of flexible tab members 48 which are formed at the forward end of each side member 42 of said cover 16. When cover 16 is in a closed or locked mode, each tab 48 is positioned adjacent the forward end of each side wall 24, as seen in FIG. 3, and are disposed forward of the terminating beveled ends of respective rails 36.

Figure 5:
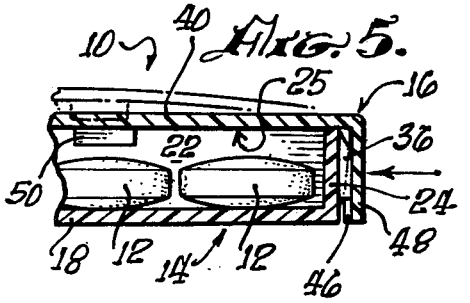
FIG. 5 is an enlarged, cross-sectional view of a portion of the container taken substantially along line 5—5 of FIG. 1 showing the arrangement of the flexible, lock-releasing tabs.
Figure 2:
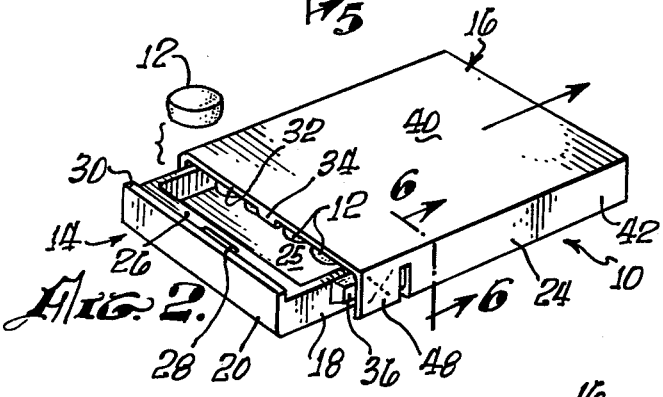
FIG. 2 is a perspective view of the device, showing the receptacle and cover in an open, unlocked position.

Thus, in order to release or disengage lug 34 from recess 28, pressure is applied by one's fingers to tabs 48 by pressing them simultaneously inwardly, causing the front edge 32 and that portion of top 40 to bow upwardly, as indicated by broken lines in FIG. 5.

The box-like receptacle is then free to slide outwardly from under cover 16. One may either push against rear wall 22 or pull on lip 30. Rails 36 will slide forward in channels 44 until rear wall 22 engages a stop means shown as a depending tongue member 50 integrally formed on the underside of top member 40. (See FIG. 4).

To reclose, one merely pushes receptacle 14 rearwardly until latch lug 34 is reseated in recess 28.

Figure 7:
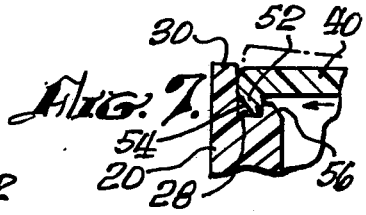
FIG. 7 is a detailed sectional view of an alternative arrangement of a locking means.

Referring now to FIG. 7, there is shown an alternative locking means wherein latching lug 52 includes a cam-surface face 54 that causes the front edge of top 40 to lift over a beveled edge 56, defining recess 28 in front wall 20.

The invention and its attendant advantages will be understood from the foregoing description; and it will be apparent that various changes may be made in the form, construction and arrangement of the parts of the invention without departing from the spirit and scope thereof or sacrificing its material advantages, the arrangement herein before described being merely by way of example; and I do not wish to be restricted to the specific form shown or uses mentioned, except as defined in the accompanying claims.

The inventor claims:

1. A dispensing-and-storage container for pills and like medication comprising:

a box-like receptacle having a forward wall member, a rear wall member, oppositely disposed side wall members, and a substantially flat bottom member defining a storage compartment to receive pills therein;

a cover slidably mounted to said receptacle, said cover having a top member and depending side members and open forward and rear ends, said cover being flexible;

releasable locking means comprising a lock recess defined in the forward wall member of the receptacle, and a locking lug depending from and adjacent to the forward edge of the cover, said lug being positioned to engage in said lock recess when the cover is in closed position;

said cover being adapted for upward bowing deformation to disengage the locking lug from the lock recess upon application of inward pressure on forward portions of the cover side members;

interengaging slide means on said side members of said cover and said side wall members of said receptacle; and stop means intermediate the ends of said top member of said cover and depending therefrom for engagement with said rear wall member of said receptacle to limit the relative sliding movement therebetween.

2. A dispensing-and-storage as recited in claim 1, and further including:

a pair of flexible tab members defined by slots in the oppositely disposed side members of said cover adjacent to and spaced from the forward end thereof, whereby said lug is raised and disengaged from said lock recess when pressure is applied inwardly on said tab members to cause said forward edge of said cover to bow upwardly.

3. A dispensing-and-storage container as recited in claim 2, wherein said slide means comprises:

a rail member longitudinally formed on each side wall member of said receptacle, the forward end of each rail terminating short of the forward ends of said wall members and cooperating with the cover side members to define a space between said side walls and said adjacent tab members, whereby said tabs may bend inwardly into said space; and longitudinal channels formed in said depending side members of said side members of said cover to slidably receive said rails therein, said channels terminating short of said tab members.

4. A dispensing-and-storage container as recited in claim 3, wherein said forward wall member of said receptacle includes an upwardly projecting wall lip for abutment with the forward edge of said cover when in a closed position.

5. A dispensing-and-storage container as recited in claim 3, wherein said stop means comprises a depending tongue member intermediate the ends of said cover to limit rearward movement of said cover.

* * * * *